United States Patent [19]

Easter

[11] Patent Number: 4,700,908

[45] Date of Patent: Oct. 20, 1987

[54] STORAGE REEL WITH SELF-ADJUSTING HUB FOR PRECOILED GOODS

[76] Inventor: Michael D. Easter, 840 J. Street, Penrose, Colo. 81240

[21] Appl. No.: 859,418

[22] Filed: May 5, 1986

[51] Int. Cl.[4] ..... B65H 75/22; B65H 75/24; B65H 75/40

[52] U.S. Cl. ..... 242/86.4; 242/110.3; 242/116; 242/118.2

[58] Field of Search ..... 242/47.5, 77, 79, 85, 242/86, 86.1, 86.2, 86.4, 94, 110.3, 115, 116, 118.2, 118.11, 118.5, 129, 170; 211/13; 239/195, 196, 197, 198; 248/89, 75

[56] References Cited

U.S. PATENT DOCUMENTS

| | | | |
|---|---|---|---|
| 881,149 | 3/1908 | Pilscheur | 242/127 X |
| 1,354,369 | 9/1920 | Anderson | 242/110.3 |
| 2,071,731 | 2/1937 | Craig et al. | 242/86 X |
| 2,267,071 | 12/1941 | Becker | 242/127 X |
| 2,971,721 | 2/1961 | Jones | 242/115 X |
| 3,326,495 | 6/1967 | Bruyn | 242/129 |
| 3,840,198 | 10/1974 | Moore | 242/116 X |

FOREIGN PATENT DOCUMENTS

| | | | |
|---|---|---|---|
| 202808 | 12/1907 | Fed. Rep. of Germany | 242/110.3 |
| 9048 | of 1888 | United Kingdom | 242/110.3 |
| 1418 | of 1911 | United Kingdom | 242/110.3 |

*Primary Examiner*—Stuart S. Levy
*Assistant Examiner*—Joseph J. Hail III
*Attorney, Agent, or Firm*—Edwin L. Spangler, Jr.

[57] ABSTRACT

This invention relates to a lightweight reel for the storage and transportation of precoiled lengths of tubing and the like characterized by two large diameter hoops together with three or more spokes for each hoop, the spokes having their adjacent ends connected together and their remote ends attached to one of the hoops in substantially radially-extending equiangularly-spaced relation, all of which cooperate with one another when thus assembled to define a pair of flanges adapted to confine the sides of an open-centered coil of precoiled goods to be positioned therebetween; and, a self-adjusting hub-forming assembly for detachably interconnecting the two flanges together through the central opening in the coil, such assembly including a subassembly for each pair of more or less transversely-aligned spokes of the two flanges consisting of an elastic member of a length less than the width of the coil to be confined between the flanges and a pair of connectors for fastening each such elastic member through the open center of the coil to opposed points on the transversely-aligned pair of flange spokes, both of the connectors of the pair associated with each elastic member being adjustable lengthwise of a spoke, at least one of the connectors in each pair thereof being detachably connectable to a spoke, and the detachable connector of the pair having springable jaws for gripping the spoke to maintain the hub-forming subassembly in radially adjusted position within the open center of the coil.

10 Claims, 1 Drawing Figure

STORAGE REEL WITH SELF-ADJUSTING HUB FOR PRECOILED GOODS

Figure 1:
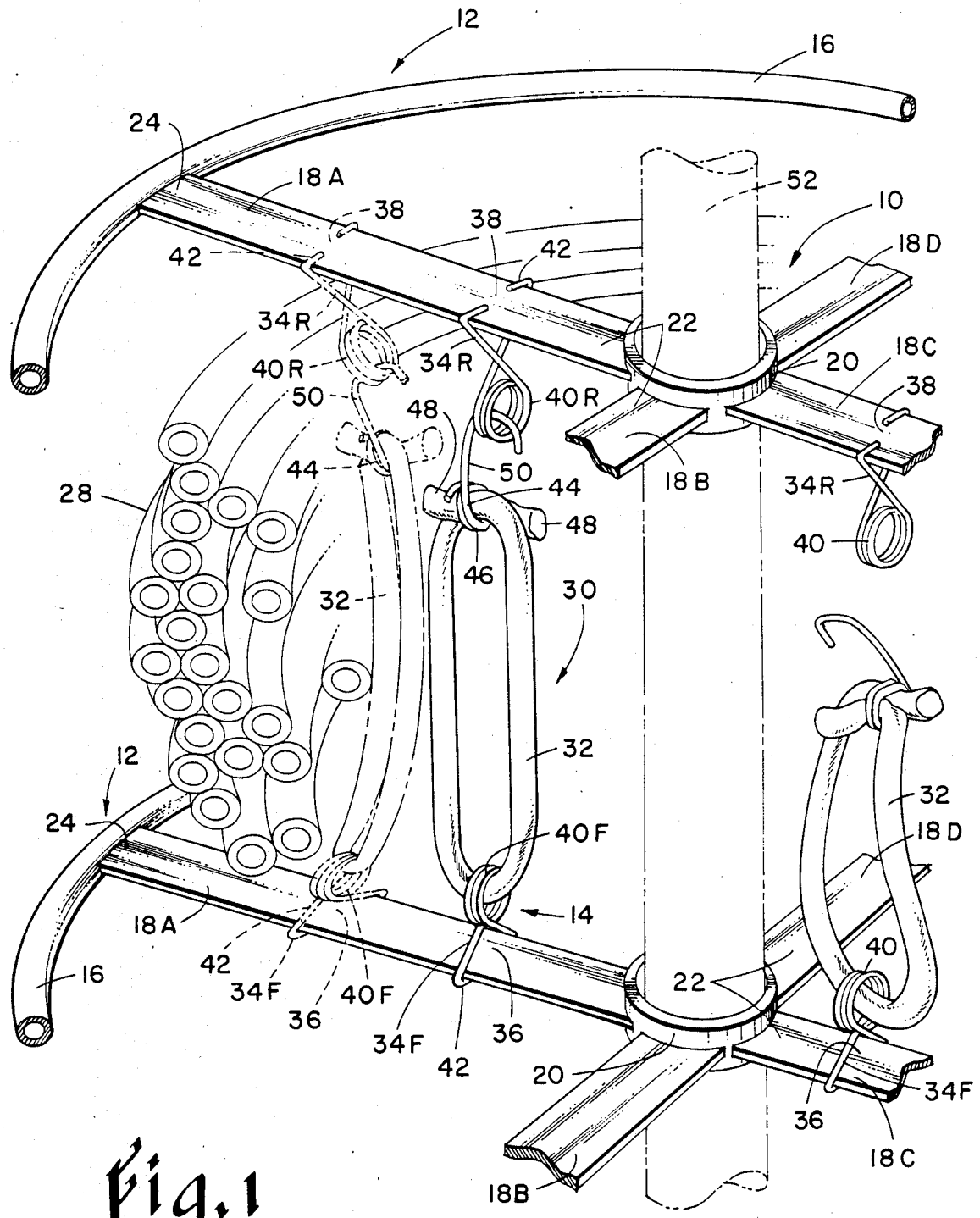

The prior art is replete with reeling devices wherein coils of material are wound upon the hub or some other part of a reel between its spaced-apart flanges. In most of these reels, the coiled goods are wound directly onto the hub which is fixed with respect to both its diameter and length, the length of the hub determining the spacing between the flanges which it supports. There remain, however, a goodly number of specialized reels including the so-called "swifts" which are reeling devices used to carry skeins of yarn in the textile industry and which have fixed hubs like those mentioned above but which differ from the conventional reel in that the coiled material is not wound upon the hub. Instead, radially-adjustable elements bridge the space between the flanges and thus define auxiliary supports for the coiled goods. The early U.S. patent to Bishop No. 303,799 discloses the concept of radially-adjustable coil support elements in the form of solid rods resting on toothed spokes that bridge the space between the flanges. A similar concept is shown in Pilscheur's U.S. Pat. No. 881,149 except that elastic bands encircle the the flanges for radial adjustment relative to the hub. Variations on this same theme will be found in the U.S. patents to Edwards Nos. 2,480,401; Miller et al 2,797,880; Weber 3,160,362; and, Williams 4,381,087. Knapp's U.S. Patent No. 3,072,358 shows a single-flanged reel that lays flat but still includes radially-adjustable coil support members. Somewhat more pertinent to the present invention are the U.S. Pat. to Keeley Nos. 1,264,942; Lee 1,638,586; and the two Becker Pat. Nos. 2,267,071 and 2,335,476, all of which use stretchable elastic elements to bridge the space between the flange-forming radial spokes. All of the above-mentioned patents have a hub which holds the flanges a fixed distance apart even though the coil-supporting elements in some instances are elastic.

Applicant is aware of only one patent, specifically U.S. Pat. No. 2,010,811 to Craig in which provision is made for varying the spacing between the flanges. In the Craig construction, water pressure expanding the hose coiled about spreader subassemblies function to decrease the effective inside diameter of the coil supported thereon while at the same time spreading the flanges apart against the bias of tension springs tending to hold them close together. As such, the Craig reel is unsuitable for use with precoiled materials since if its flanges were spread apart to accept a wide coil of precoiled hose, it could not accommodate the pressure exerted by the confined innermost coils that are filling with water from the hub. Premature spreading of the flanges to accept a wide precoiled length of reelable material would, therefore, render the Craig reel useless for its intended purpose. Moreover, Craig's reel makes no provision whatsoever for radially-adjusting his coil support elements to accommodate precoiled materials having open centers of different diameters. Accordingly, for the Craig reel to operate, it must, of necessity, have the hose wound thereon coil by coil and loosely enough to prevent premature actuation of the spreader subassemblies.

There exists a need, therefore, for an inexpensive, lightweight reel for the transportation and storage of precoiled materials like, for example, polyvinylchloride (pvc) irrigation pipe, other types of plastic tubing and the like. Such materials are customarily delivered from the factory in precoiled form but without any reels. The coils vary in length, outside diameter, in width and in inside diameter; therefore, it is virtually impossible to use a stock reel of conventional design. Moreover, to unwind hundreds of feet of tubing and rewind it onto a reel with flanges fixed to a hub is time-consuming, labor-intensive and, frankly, hardly worth the effort for the simple reason that it is easier to haul the coil around and even unwind it without it being on a reel. If, on the other hand, it could be transferred to a reel without having to uncoil and recoil it, there are a number of advantages resulting from being able to do so. For instance, it can be transported from place to place more easily by just rolling the reel along the ground. Also, there is the obvious advantage of having the coil supported on a reel when the time comes to unwind it, especially if the reel itself is mounted for rotation about either a vertical or horizontal axis.

It has now been found in accordance with the teaching of the instant invention that these and other worthwhile objectives can, in fact, be realized by the simple, yet unobvious, expedient of designing a reel having separable flanges detachably interconnected by a self-adjusting hub assembly that will automatically accommodate any width coil of precoiled material. The same subassemblies that cooperate to produce the self-adjusting hub are also radially adjustable at the will of the user to fit the inside diameters of the precoiled materials. Thus, while it is old in the art to effect radial adjustment of the coil-supporting elements of a reeling device, to applicant's knowledge, this has never been done with the same subassemblies which define a self-adjusting hub. Moreover, while it is very apparent that many of the prior art reels can be taken apart and reassembled, there seems to be no suggestion that to do so would be advantageous in the handling of precoiled materials.

It is, therefore, the principal object of the present invention to provide a novel and improved storage reel for precoiled materials.

A second objective is the provision of a device of the class described which is designed for assembly in relation to the precoiled material, not the other way around.

Another object of the invention herein disclosed and claimed is to provide a reel with a self-adjusting hub which is both expandable and retractable depending upon the width of the coil of the precoiled material.

Still another objective is that of providing reel flanges with rings at the center thereof positionable in transversely-spaced coaxial relation to one another and adapted when so positioned to receive an axle therebetween about which the reel can be rotated.

An additional object is to provide a knocked-down reel assemblable about precoiled materials which is readily adjustable to coils of different inside diameters and self-adjustable to the width thereof using the self-same subassemblies for both purposes.

Further objects of the invention are to provide a reel especially suited for use with precoiled lengths of plastic pipe and tubing which is simple, inexpensive, easy to use, lightweight yet strong, compact, rugged, versatile and even somewhat decorative.

Other objects will be in part apparent and in part pointed out specifically hereinafter in connection with the description of the drawings that follows, and in which:

FIG. 1 is a fragmentary perspective view showing the reel filled with a precoiled length of plastic tubing and temporarily mounted in horizontal position upon an axle for rotation about a vertical axis.

Referring next to the single figure of drawings for a detailed description of the present invention, reference numeral 10 has been selected to designate the reel in a general way while numerals 12 and 14 have been chosen to similarly refer to the flanges and hub-forming assembly thereof, respectively. There are two flanges 12, each of which comprises a generally circular hoop 16 preferably fabricated from some relatively rigid material which may either be solid or tubular although the latter is preferred for weight considerations, a series of at least three spokes 18 and a centerpiece 20. The centerpiece 20 is preferably positioned at or at least relatively close to the center of the hoop 16 and it functions in the manner shown as the connector for the inner or adjacent ends 22 of the more or less radially-extending spokes 18. As such, the centerpiece could constitute nothing more than a fastener, however, in the preferred embodiment illustrated, it is a ring which posesses significant functional advantages that will be set forth in detail presently. The outer or remote ends 24 of the spokes are attached to the hoop, preferably in equiangularly-spaced relation to one another. The spokes are shown in the form of flat bands welded at both ends to the hoop and centerpiece, respectively. Since, for the most part, the loads imposed upon the spokes are not great when used to confine precoiled lengths of plastic pipe and tubing 28, they needn't be particularly thick or even rigid, thus minimizing the weight along with the cost of the flanges. Whatever the number of spokes, both flanges have the same number and they are arranged in transversely-aligned pairs, each pair being interconnected by subassemblies of the hub assembly 14 that have been designated broadly by reference numeral 30.

Each of the subassemblies 30, in the particular form illustrated, will be seen to include a stretchable elastic member 32 each having connectors 34 at opposite extremities thereof for connecting the latter to points 36 and 38 on transversely-aligned pairs (18A, 18B, 18C and 18D) of the flange spokes 18. As illustrated, connectors 34, while detachable, are left more or less permanently attached to their respective spokes while, at the same time, remaining adjustable throughout the length thereof as shown by full and phantom lines.

Each connector 34 will be seen to comprise a coiled portion 40 terminating at opposite ends in a pair of opposed integrally-formed springable jaws 42 adapted to be spread apart and released into gripping relation on one of the spokes at any selected position throughout its length. In the case of connector 34F, its coiled portion 40F is more or less permanently attached to the elastic member 32 which is shown in the form of a loop although, obviously, it could comprise a single length of elastic material. Connector 34R, on the other hand, is not connected directly to the elastic member 32, but instead, is detachably connected thereto by a hook member 44. Hook member 44 includes a portion 46 coiled around the overlapped ends 48 of the elastic member in a manner to hold them together and an integrally-formed hook 50 which is detachably received in the coiled portion 40R of connector 34R. As thus constructed, both of the spring-jawed connectors 34R and 34F along with the elastic member 32 attached to the latter remain connected to one of the spokes 18 of one of the flanges at all times thus preventing any element of these subassemblies 30 from becoming lost or misplaced. For convenience sake, it is probably best to have all the elastic members 32 and their associated connectors 34F carried by the same flange although, of course, this is not necessarily so. It is important that the effective length of each of the subassemblies 30 be somewhat less than that of the minimum width coil of precoiled material that the hub assembly 14 is designed to span or bridge so that the elastic members 32 will each be stretched and continuously operative to bias the flanges in tight against the sides of the coil 28 regardless of its width.

By making the centerpieces 20 in the form of rings and arranging them in coaxial transversely-aligned relation, they function as journals for axle 52 which supports the reel 10 for rotational movement so that the precoiled material 28 can be unwound therefrom either standing upright or laying flat as shown. When supported in an upright position, axle 52 also provides a convenient means form rolling the reel and its contents along the ground.

From the above description of the reel, it should be apparent that it becomes a simple operation to mount a coil of the precoiled material 28 thereon. First, one of the flanges 12 is laid flat on the ground. It really doesn"t matter too much which one since the only difference is whether the user has to pull up or push down on the connector subassemblies 30 in order to stretch the elastic members 32 to the degree where the hook 50 can be hooked into the coiled portion 40R of the connector 34R. Next, while the connector subassemblies 30 remain disconnected, the length of precoiled material 28 is laid atop the flange lying on the ground and more or less centered thereon. With the coil appropriately positioned atop the one flange, the second one is laid on top of the coil with its spokes 18 reasonably well aligned with the spokes of the first flange therebeneath. At this point the user has two options. He or she can, first of all, hook up each of the connector subassemblies while positioned well inside the innermost coils of the precoiled tubing as shown in full lines before sliding the entire subassembly thus connected outwardly into the phantom line position in supporting hub-forming relation to the coiled material or, alternatively, slide the connectors 34F and 34R out first and then hook them together in the phantom line position. Either way, the final result is the same. Note also, that this entire operation can be accomplished without axle 52 being in place although, obviously, its presence does not interfere in any way with the mounting of the coil. Once all the connector subassemblies 30 have been connected across the gap between the flanges and snugged up against the innermost coils of the precoiled material, the reel can be stood upright, rolled along the ground to a new location and otherwise handled as any coiled material on a reel. Even if the centerpieces happen to be slightly misaligned, standing the reel on edge and rolling it along the ground will generally result in the flanges shifting into aligned substantially coaxial relation and, in this sense, the elements of the reel are self-aligning to a considerable degree.

What is claimed is:

1. The hubless reel for the storage of precoiled lengths of tubing and the like which comprises: a pair of generally circular rigid hoops and at least three elongate radially-extending spokes within each hoop, said spokes each having remote ends connected to the hoop and adjacent ends connected together at the center thereof, said spokes and hoops cooperating with one another to produce a pair of substantially identical reel flanges; and, coil-supporting means for detachably connecting said flanges together in transversely-spaced relation, said means comprising a first connector means mounted on the spokes of one of said flanges for adjustable movement therealong between the ends thereof, a second connector means mounted on the spokes of the other of said flanges for movement therealong between the ends thereof, an elastic member attached to one of said first and second connector means and detachably connectable to the other of said connector means when they are positioned in generally opposed relation to one another, said first and second connector means together with the elastic member therebetween cooperating with one another when thus interconnected to define radially-adjustable subassemblies effective to support the inside of a coil of precoiled material positioned between the flanges upon being adjusted radially outward thereagainst while simultaneously biasing said flanges into contact with the sides thereof.

2. The storage reel for precoiled materials as set forth in claim 1 in which: at least one of said first and second connector means includes springable jaws adapted to releasably grip the spoke and maintain the adjusted position thereof.

3. The storage reel for precoiled materials as set forth in claim 1 in which: both of said first and second connector means include springable jaws adapted to releasably grip their respective spokes and thus maintain the particular subassembly of which they form a part in radially adjusted position.

4. The storage reel for precoiled materials as set forth in claim 1 in which: hook means depend from the elastic member for detachably hooking same to the second connector means.

5. The storage reel for precoiled materials as set forth in claim 1 in which: the overall length of the subassemblies that interconnect the flanges is less than the width of the precoiled material to be confined therebetween when the elastic members are in relaxed condition.

6. The storage reel for precoiled materials as set forth in claim 1 in which: means comprising a ring interconnects the adjacent ends of the spokes of each flange, said rings when positioned in spaced substantially coaxial relation to one another cooperating to define journals for.mounting the reel upon an axle for rotational movement.

7. The storage reel for precoiled materials as set forth in claim 2 in which: the springable jaws are openable to receive the spoke.

8. The storage reel for precoiled materials as set forth in claim 3 in which: the springable jaws of both connector means are openable to receive their respective spokes

9. The storage reel for precoiled materials as set forth in claim 4 in which: the elastic member comprises a length of rubber formed into a loop having overlapped ends; and, in which the hook means includes a coiled portion coiled around said overlapped ends for holding them together.

10. The storage reel for precoiled materials as set forth in claim 6 in which: the rings are located at the center of the hoops.

* * * * *